United States Patent [19]

King

[11] Patent Number: 5,003,939

[45] Date of Patent: Apr. 2, 1991

[54] VALVE DURATION AND LIFT VARIATOR FOR INTERNAL COMBUSTION ENGINES

[76] Inventor: Brian T. King, 48000 Elkview Rd., RR #2, Sardis, B.C., Canada

[21] Appl. No.: 486,599

[22] Filed: Feb. 26, 1990

[51] Int. Cl.[5] ..... F01L 1/34

[52] U.S. Cl. ..... 123/90.16; 123/90.17

[58] Field of Search ..... 123/90.12, 90.15, 90.16, 123/90.39, 90.41, 308, 432

[56] References Cited

U.S. PATENT DOCUMENTS

| | | | |
|---|---|---|---|
| 4,285,310 | 8/1981 | Takizawa et al. | 123/432 |
| 4,469,056 | 9/1984 | Tourtelot, Jr. et al. | 123/90.16 |
| 4,502,425 | 3/1985 | Wride | 123/90.16 |
| 4,502,426 | 3/1985 | Skelley | 123/90.15 |
| 4,552,112 | 11/1985 | Nagao et al. | 123/308 |
| 4,572,188 | 2/1986 | Baguena | 123/90.16 |
| 4,856,473 | 8/1989 | Kawai et al. | 123/308 |
| 4,901,684 | 2/1990 | Wride | 123/90.16 |

FOREIGN PATENT DOCUMENTS

| | | | |
|---|---|---|---|
| 219529 | 2/1910 | Fed. Rep. of Germany | 123/90.16 |

*Primary Examiner*—David A. Okonsky

*Assistant Examiner*—Weilan Lo

[57] ABSTRACT

A device for varying steplessly, throughout the operating range of an internal combustion engine, the duration of the processes of induction and exhaust, and the lift of the valves associated with these processes; the device employing, within a four valve combustion chamber, a pair of valves for each of the functions of induction and exhaust; each pair of valves being driven by a different camshaft; for each valve, a rotatable drum of common axis with the camshaft, and having a valve actuating rocker arm pivoted at one end within the drum; wherein angular rotation of the drum causes the cam to reciprocate the rocker arm, and therefore, the valve, at a point earlier or later in cam rotation; the combination, for instance, of an advanced opening point of the first valve, and a retarded closing point of the second valve, giving an extended duration of the process associated with the two valves. The feature of variable valve lift occurring when angular rotation of the drum alters the geometric relationship between the rocker arm pivot, the cam contact pad on the rocker arm, and the free end of the rocker arm which drives the valve.

8 Claims, 7 Drawing Sheets

3
2
13
1
1a
14
4b
4a
4
10
9
7
8
11
5
6
17
18
15
12
16

3
2
1a
1
4a
4
4b
18
11
17
8
12
16

VALVE DURATION AND LIFT VARIATOR FOR INTERNAL COMBUSTION ENGINES

FIELD OF THE INVENTION

The present invention relates to an internal combustion engine and more particularly to a method and apparatus for varying the duration of the processes of induction and exhaust, and the lift of the valves associated with those processes.

BACKGROUND OF THE INVENTION

It is recognised in the art that the non-variable nature of valve duration and valve lift in the internal combustion engine are serious impediments to optimal efficiency.

The varying dynamics of an engine having optimal efficiency throughout the range of its operation would demand continuous adjustments in the duration of the processes of induction and exhaust; continuous adjustments in the relationship of one process to another; and continuous adjustments in valve open area defined by valve lift.

The benefits of such a system would be considerable improvements in the areas of economy, reduced emmission levels and increased power. The benefits to torque characteristics of such an engine would allow smaller engines for given vehicle weight; the weight saving so achieved improving overall vehicle efficiency still further.

In view of these facts, many attempts have been made to provide a mechanism capable of giving at least some of the above benefits.

The difficulties in producing such inventions lie, not in designing reliable mechanisms to bodily re-index a camshaft relative to crankshaft rotation, since one or two such systems are in production—Mercedes and Toyota, for example—but are capable of achieving only a minor effect since a simple reindexing of the camshaft cannot provide a variation in the duration of an induction or exhaust process, and cannot effect valve lift.

Accordingly, attempts have been made, for instance, to apply the aforesaid principle of re-indexing to a pair of camlobes operating a single valve, with mechanisms that attempt to combine the motion of the opening flank of a first camlobe with the motion of the closing flank of a second camlobe, and by variably indexing the two camlobes relative to each other, producing a variation in the duration of the valve.

Results stemming from this approach illustrate the extreme difficulty in combining the disparate motions generated by two camlobes differentially phased into a single motion of use in this context. FIG. 5 of the drawings depicts a sample of this dynamically unacceptable valve motion.

Accordingly, a system is proposed by the inventor that provides continuously variable duration of the exhaust and induction processes, without altering the duration of the valves associated with such functions, and without departing from the dynamics of camlobe/-valve relationships that are proven in all engines having conventional non-variable valve train systems.

Additionally, it is a feature of the proposed invention that it provides continuously variable valve lift to further optimize engine performance.

SUMMARY OF THE INVENTION

An object of this invention is to provide, in an internal combustion engine employing jointly two valves per combustion chamber for each of the functions of exhaust and induction, a mechanism for varying optimally, throughout the operating range of the engine, the duration, relative to crankshaft rotation, of the induction and exhaust processes.

Another object of this invention is to provide, in an internal combustion engine, a mechanism for varying optimally, throughout the operating range of the engine, the lift of the valves associated with the processes of induction and exhaust.

These objects, as well as other objects which will become apparent from the discussion that follows, are achieved, according to the present invention, and considering, for example, the process of induction, by employing two inlet valves for this process, and, by advancing relative to crankshaft rotation, the phasing of the first inlet valve, while retarding, relative to crankshaft rotation, the phasing of the second inlet valve, extending the duration, relative to crankshaft rotation, of the process of induction; this extended duration process being defined by the advanced opening point of the first inlet valve, and the retarded closing point of the second inlet valve; the mechanism and method for achieving duration of a process being equally applicable, obviously, to the pair of valves associated functionally with the exhaust process; the aforesaid extension of the processes of duration arranged to occur, generally, with an increase in engine speed, and a reduction of duration, generally, to occur with a reduction of engine speed; exceptions to these relationships occurring, for example, under steady-state cruising conditions of the vehicle, when a reduced exhaust and induction process duration, and a reduced valve lift, may be required to optimize engine operating efficiency; these, and many other available variations, being recognized in the art as being relevant to optimized engine efficiency. The aforementioned object of variable duration of induction and exhaust processes is achieved by the present invention without varying the duration of the two valves associated with a function of induction or exhaust, thus avoiding the problems discussed in the section on "Background of the Invention."

The second object of the invention is to provide variable valve lift throughout the operating range of the engine—this feature being recognized in the art as necessary to optimize engine performance.

To achieve the objects in accordance with the purpose of the invention and broadly described herein, the apparatus of the present invention comprises a mechanism for each valve of a Double Over Head Cam cylinder head having four valves per cylinder; wherein two of said valves are inlet valves and two are exhaust valves; each pair of valves being driven by a different camshaft.

Surrounding each camshaft and being of common axis with it, is a drum, this drum being rotatably embraced by a housing fixed relative to the cylinder head, the periphery of the drum being interposed between the cam and the housing. The drum is capable of angular rotation and is so driven by a linkeage connecting the drum to a hydraulic piston reciprocally received in a bore defined by portions of the cylinder head; the piston defining a hydraulic cylinder within the bore and being actuated by hydraulic pressure from a pressure source subject to demand signals generated by a sensor monitoring one or more engine operating requirements. The hydraulic pressure applied to the piston is countered, for control purposes, by a biasing spring within the hydraulic cylinder.

A rocker arm having a fulcrum end rotating about a pivot located fixedly in the drum, a contact pad to engage a camlobe located on the camshaft; a biasing spring to maintain sliding engagement between the rocker contact pad and the camlobe; a free end capable of substantially reciprocal motion, and having an arcuate surface described by a radius having a centre coincident with the camshaft axis, engages for driving purposes a roller rotating about a pivot fixedly supported by structural extensions of a bucket tappet, reciprocally housed within a bore defined by portions of the cylinder head for driving a first valve; the arcuate surface having as its object the maintainence of a predetermined clearance, throughout the full range of drum angularity, between the free end of the rocker arm and the roller.

By way of example, in response to a demand signal for extended duration of the process of induction, hydraulic pressure is metered to the hydraulic cylinder, overcoming the bias of the spring and causing the connecting linkeage to rotate the drum, in a direction contrary to the rotation of the camshaft, from a first angular position to a second angular position. Rotation of the drum carries with it the rocker arm, the camlobe engagement pad integral with the rocker arm contacting the camlobe fixed in rotation with the camshaft, at a point, advanced in terms of camshaft rotation, and therefore in terms of crankshaft rotation; contact between the camlobe and the engagement pad of the rocker arm reciprocating the free end of the rocker arm, which in turn opens the inlet valve; this opening of the inlet valve defining the commencement of the induction process.

It will be remembered, at this point, that two valves are engaged in the induction process, and it should be noted therefore, that while the first of the two valves so engaged has, by virtue of the mechanism and method just described, been caused to open at an advanced angular position relative to crankshaft rotation, the second of the two inlet valves will by virtue of its own drum mechanism rotating in a direction contrary to the rotation of the drum associated with the first valve, close at a retarded angular position relative to crankshaft rotation; this closing of the second inlet valve defining the termination of the induction process. Thus, by advancing the first inlet valve, while retarding the second, an extension of the induction process is achieved.

It will be understood that a similar extension of the exhaust process will, as desired, occur simultaneously due to each of the two exhaust valves being controlled by a mechanism and method similar to that employed for each inlet valve, and due to the control system being programmed to accomplish this end. It will likewise be appreciated that contraction of the duration of the processes of induction and exhaust is achieved by reversing the processes, just described, that produced an extension of the induction process.

The second object of this invention, that of variable valve lift, is achieved by the same mechanism that accomplishes the aforesaid variable phasing of the valve events of opening and closing, as follows: as the drum bearing a rocker arm for rotation about a pivot fixed in said drum rotates angularly in response to a demand signal, it carries with it the aforementioned rocker arm. A movement of the aforesaid rocker arm alters the distance relationship existing between the rocker arm pivot and the point on the free end of the rocker arm where it contacts, for driving purposes, the valve. The distance relationship that exists between the rocker arm pivot and the cam contact pad integral with the rocker arm remains the same throughout the full angular movement of the drum. It will be seen therefore, that any variation in the distance relationship that exists between the rocker arm pivot and the point on the free end of the rocker arm where it contacts the valve, will result in a variation in ratio between the lift of the camlobe, and the lift of the valve.

Further benefits to engine efficiency will be achieved by employing, singly or in combination, different sized valves within a pair of valves associated with a common function of induction, or of exhaust, by arranging for either valve of a pair jointly associated with a common function to open first; and by employing, as desired, dissimilar camlobe profiles within a pair of camlobes jointly associated, for driving purposes, with a pair of valves of common function within a combustion chamber; the resulting benefits arising from optimization of volumetric efficiency, cylinder scavenging, swirl and turbulence and the like, as recognized in the art as being beneficial to engine efficiency.

BRIEF DESCRIPTION OF THE DRAWINGS

The above, and many other aspects, features and advantages of the present invention, will be better appreciated as the description of the preferred embodiments is made in conjunction with the attached drawings in which.

and valve "B", with valve "A" having priority of opening.

Figure 11:
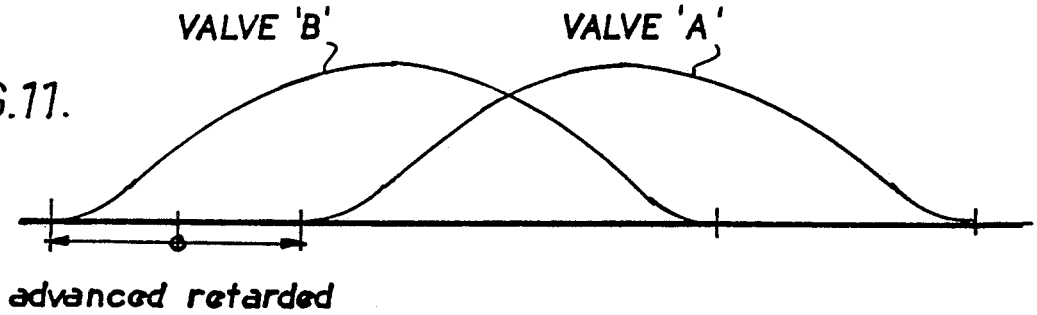

FIG. 11. Depicts lift curves of a pair of valves of common function designated respectively, valve "A" and valve "B", with valve "B" having priority of opening.

Figure 12:
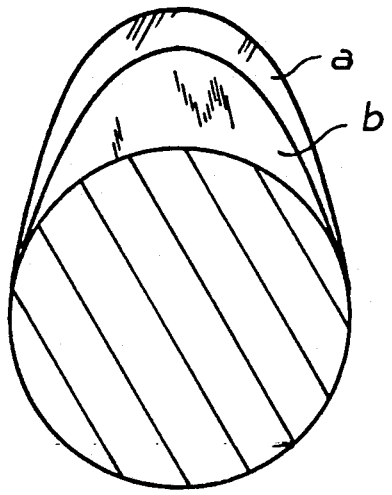

FIG. 12. Depicts camlobes "a" and "b" of dissimilar profiles within a pair of camlobes jointly associated with one of a process of induction and exhaust.

DETAILED DESCRIPTION OF THE PREFERRED EMBODIMENTS

Figures 1, 2:
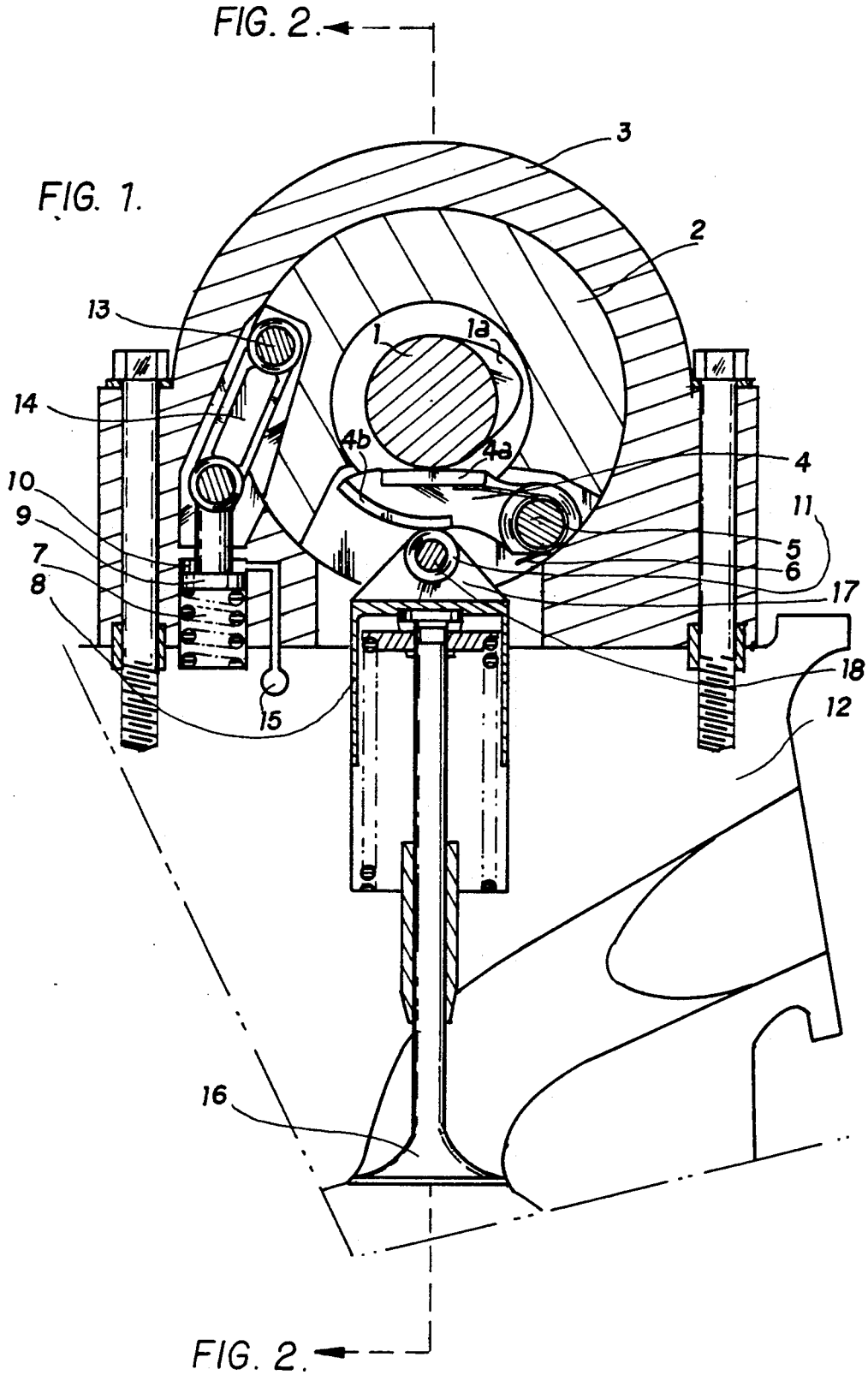
FIG. 1 Shows in section a variable valve timing mechanism operating a single valve of a pair jointly associated with one of a process of induction and exhaust.
FIG. 2 Is a sectional drawing depicting, within a combustion chamber, a pair of valves of common function of induction or of exhaust; the separate driving mechanisms employed; and the camlobes associated with these mechanisms.
Figures 1, 2:
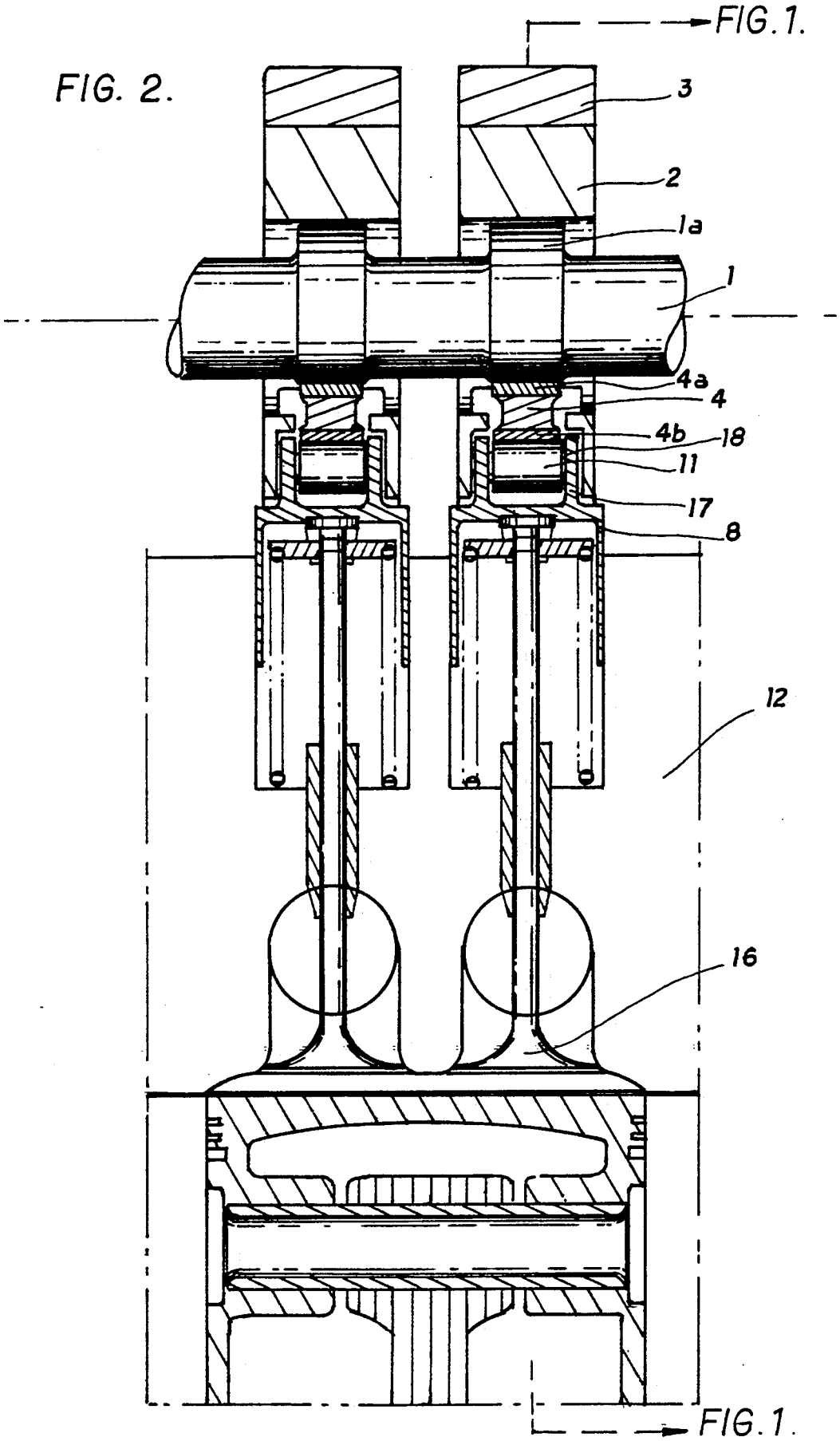
Figure 3:
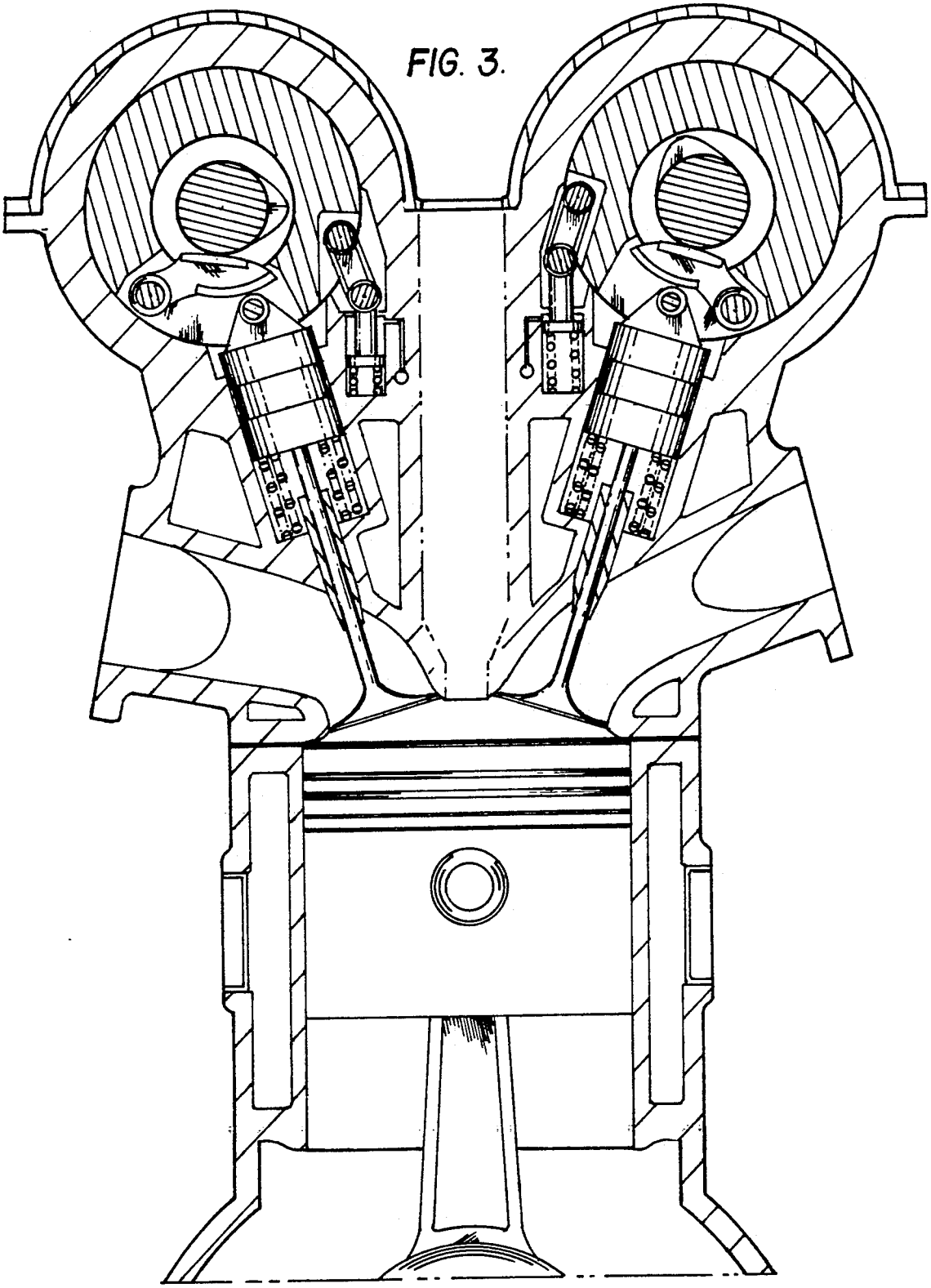
FIG. 3 Shows in frontal section, a general layout of a D.O.H.C. 4 valve per cylinder layout. One of a pair of exhaust valves, and one of a pair of inlet valves are shown, each valve having a variable valve timing mechanism.
Figure 4:
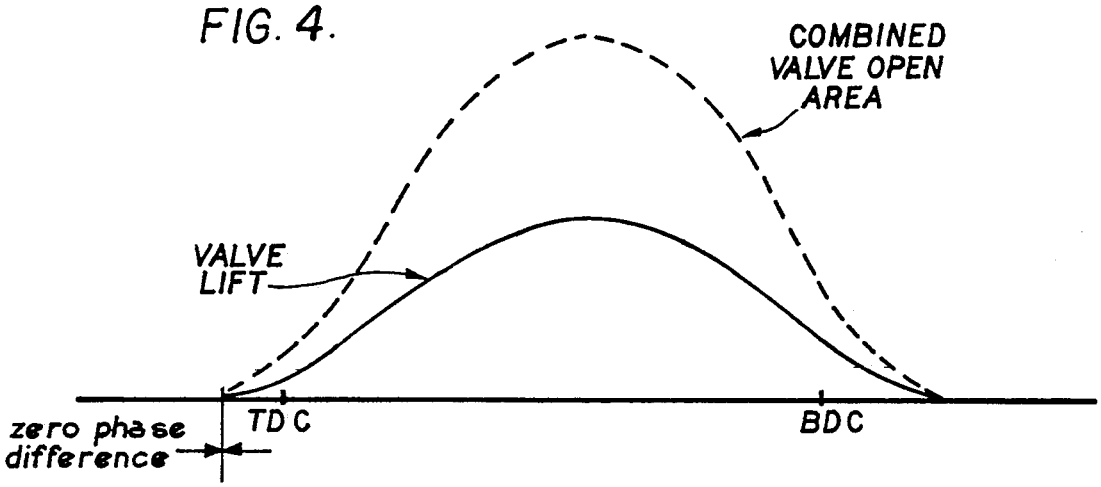
FIG. 4 Depicts curves of valve lift and resulting valve open area of a pair of inlet valves individually controlled by separate camlobes at simultaneous phasing.
Figure 5:
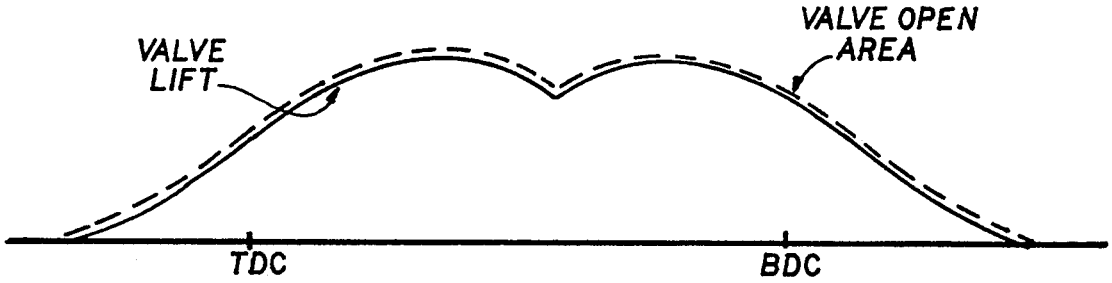
FIG. 5 Shows curves of valve lift and resulting valve open area of a single inlet valve controlled jointly by two camlobes at differential phasing.

FIG. 1 of the drawings shows a variable duration and valve lift device actuating a single valve of a pair jointly associated with a common function of induction and exhaust in the combustion chamber of an internal combustion engine, this being the preferred embodiment of the present invention.

This arrangement, by way of example, takes the form of one camshaft of a Double Overhead Cam 4 Valve per Cylinder arrangement, a general layout of which is depicted in FIG. 2.

As shown, camlobe 1A induces reciprocation of rocker arm 4 rotating at its fulcrum end about a pivot 5 secured in angularly rotating drum 2 rotatably embraced by housing 3 fixed relative to cylinder head 12. Rocker arm 4 is biased towards camlobe 1A by biasing spring 6 to maintain sliding contact between rocker arm pad 4A and camlobe 1A. The free end of rocker arm 4 has an arcuate surface 4B which contacts roller 11 of bucket tappet 8 reciprocally received in cylinder head 12.

The arrangement for rotating angularly drum 2 consists of hydraulic pressure responsive piston 9 reciprocally received within a bore formed in housing 3. Hydraulic pressure responsive piston 9 defines a variable volume hydraulic chamber 10 within said bore, and is biased against hydraulic pressure in chamber by spring 7. Hydraulic pressure responsive piston 9 is connected to pivot 13 in drum 2 by connective linkeage 14. It will be appreciated that as hydraulic pressure from pressure source 15 increases sufficiently to overcome the contrary bias of biasing spring 7, the motion of hydraulic pressure responsive piston 9 transmitted through linkeage 14 to pivot 13 will rotate drum 2 through a predetermined angle relative to the housing 3. This rotation of drum 2 will be contrary to the rotation of cam 1 and will cause rocker arm pad 4A to contact the opening flank of camlobe 1A at a point earlier in camshaft rotation, thus advancing the opening point of valve 16 relative to crankshaft rotation.

Contrarily, when rotation of drum 2 is of the same direction of rotation as cam 1, rocker arm pad 4A will contact the opening flank of camlobe 1A at a point later in camshaft rotation, thus retarding the opening point of valve 16 relative to crankshaft rotation.

Thus it will be seen, for example, that when, as in the preferred embodiment of this invention, two valves of a common function are associated with a single combustion chamber, and each of these valves is actuated by a separate variable valve timing system as described, it becomes possible to vary the timing of the opening and closing events of the first valve relative to the timing of the opening and closing events of the second valve.

Thus, considering for example, a pair of intake valves, by rotating angularly in a direction contrary to camshaft rotation the drum operatively associated with the first intake valve; and by rotating angularly, in a direction the same as the direction of camshaft rotation the drum operatively associated with the second intake valve, the first intake valve will have an opening point advanced relative to crankshaft rotation; and the second valve will have a closing point retarded relative to crankshaft rotation. Thus the duration, in terms of crankshaft rotation, between the opening point of the first valve, and the closing point of the second valve will be increased; thus increasing, in terms of crankshaft rotation, the duration of the induction process.

Figure 6:
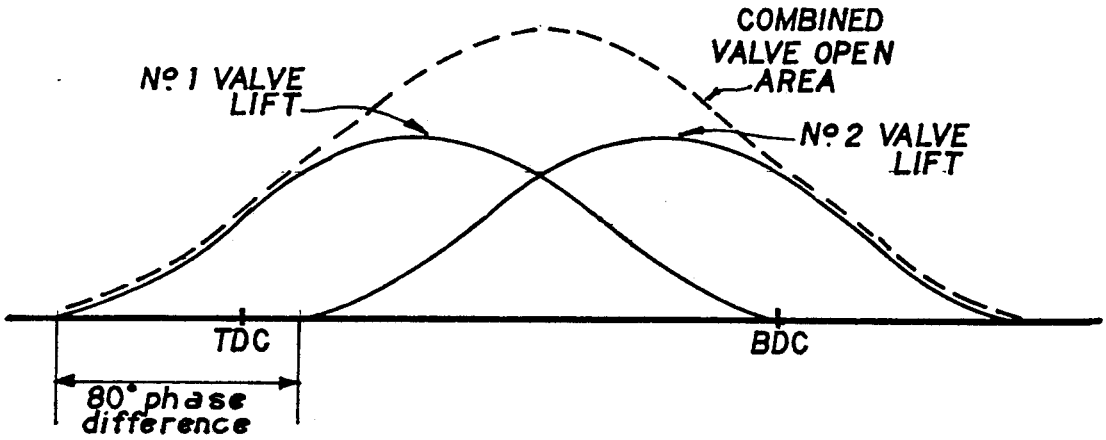
FIG. 6 Shows curves of valve lift and resulting valve open area of a pair of inlet valves controlled by separate camlobes at differential phasing.
Figure 7:
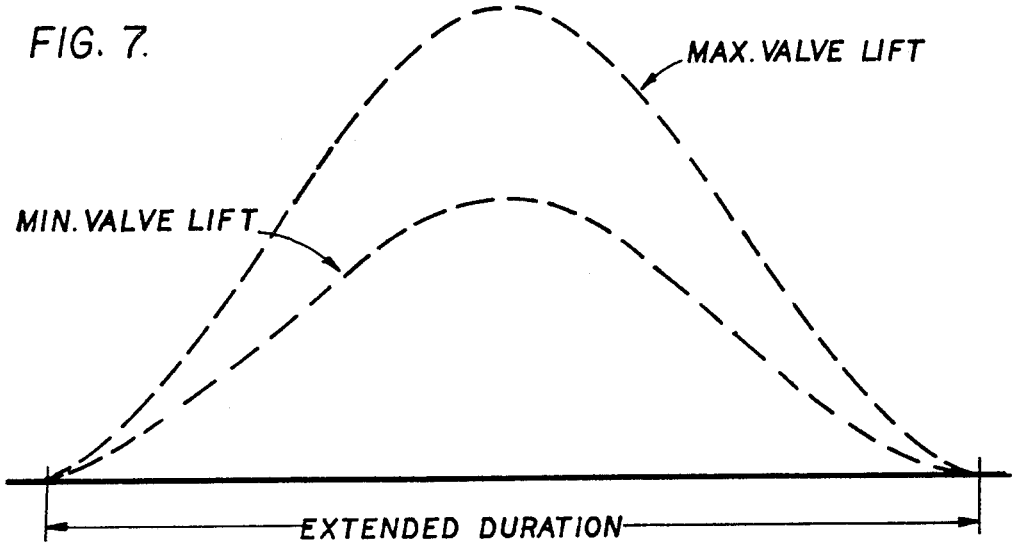
FIG. 7 Shows curves of minimum and maximum valve lift generated at an extended duration by the variable valve lift device.

It will be appreciated that this variation of the duration of the induction process is achieved without varying the duration of the open period of either valve, relative to the crankshaft rotation, and without therefore, departing from proven, conventional valve train dynamics. This is shown in FIG. 6.

A further aspect of the preferred embodiment of the present invention is the feature of variable valve lift, wherein a variation in valve lift occurs when, in response to engine demand, drum 2 is rotated angularly from a first to a second position. Rocker arm 4, being rotatably anchored at its fulcrum by a pivot 5 in drum 2, rotates with drum 2. Rocker arm 4 has an arcuate surface 4B engaging a roller 11 rotating about a pivot 18 supported by structural extensions 17 of bucket tappet 8. With drum 2 at a first angular position, arcuate surface 4B engages roller 11 at a first distance relationship with respect to rocker arm pivot 5, said relationship producing a predetermined ratio between lift of camlobe 1A and displacement of valve 16 driven by bucket tappet 8.

The curvature of arcuate surface 4B is a product of a radius with its center coincident with the axis of cam 1; and with rocker arm contact pad 4A biased into sliding contact with camlobe 1A by biasing spring 6, provides a predetermined operating clearance, throughout the full range of drum angularity, between arcuate surface 4B of rocker arm 4 and roller 11, with valve in the closed position. Thus, proper valve clearances are maintained. Returning to the variable valve lift feature of the present invention, as rocker arm 4 rotates with drum 2, a variation is produced in the distance relationship between the fulcrum of rocker arm 4 and the point on arcuate surface 4B where it contacts roller 11, thus producing a variation in the ratio between camlobe lift and valve lift.

It will be appreciated that the same change in first drum angularity that produces an advanced inlet valve opening point relative to crankshaft rotation, also produces an increased inlet valve lift.

It will be further appreciated that the same change in second drum angularity relative to crankshaft rotation that produces a retarded second inlet valve closing point relative to crankshaft rotation, also produces an increased inlet valve lift.

Thus, it will be seen that the combination of an advanced first intake valve opening point relative to crankshaft rotation, and a retarded second valve closing point relative to crankshaft rotation will produce an extended duration of the intake process relative to crankshaft rotation; and it is known in the art that this is desirable with an increase in engine speed. Further, it will be appreciated that the increased valve lift that occurs simultaneously with an extended duration, relative to crankshaft rotation, of the intake process, is also desirable with an increase in engine speed. It will be still further appreciated that, just as drum angularity changes are stepless between predetermined limits, so are variations in valve lift stepless between predetermined limits; the features of variable duration of function, and variable valve lift combining to optimize engine performance. FIG. 6 shows maximum and minimum valve lift of the device.

Obviously, the mechanism and method just described are intended, in the preferred embodiment of the present invention, to be also applied to the actuation of a pair of exhaust valves in a combustion chamber.

Figure 8:
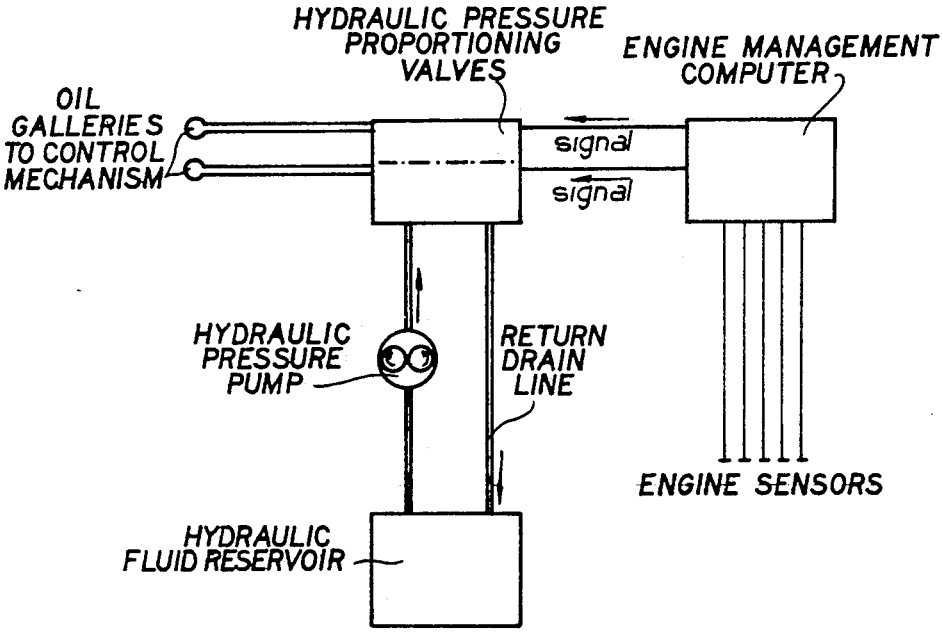
FIG. 8 Depicts, in schematic, a general layout of a control system.
Figure 9:
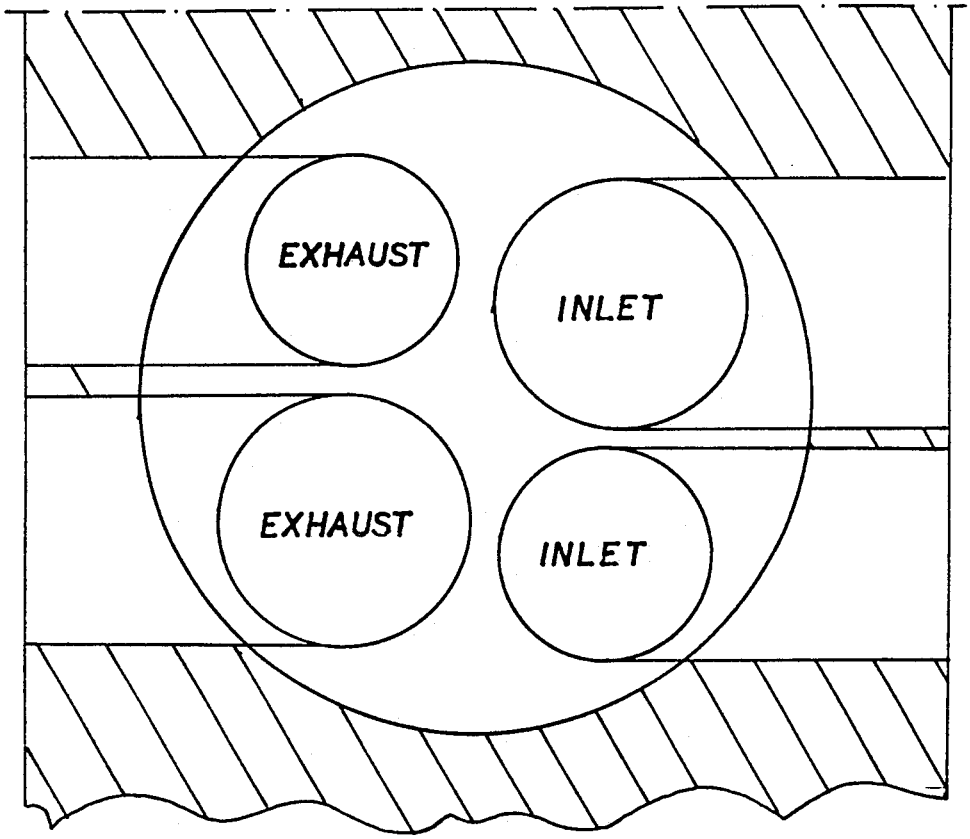
FIG. 9. Depicts within a combustion chamber valves of different sizes within a pair jointly associated functionally with one of a process of induction and exhaust.
Figure 10:
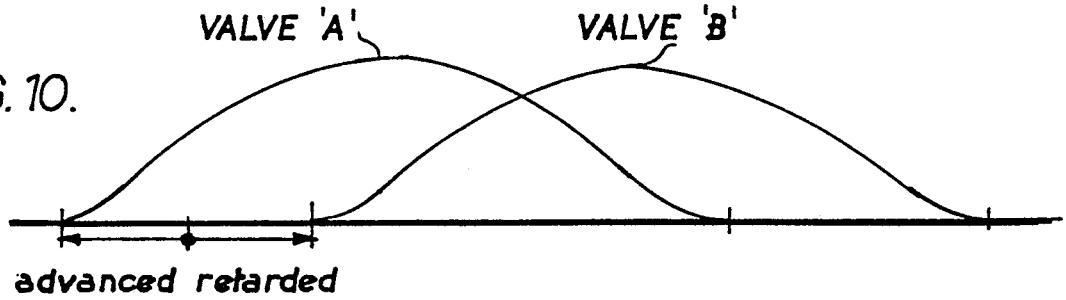
FIG. 10. Depicts lift curves of a pair of valves of common function designated respectively valve "A"

Turning to FIG. 8, wherein the control system pertaining to the preferred embodiment of the present invention is depicted in general layout form, we see that, in response to one or more engine operating requirements and conditions, engine sensors send signals to an engine management computer of well known per se type; the computer calculates requirements on the basis of this information, and signals the hydraulic pressure proportioning valve, whereby, according to requirements, hydraulic pressure is fed to the pressure responsive pistons controlling drum angularity from a source of hydraulic fluid under pressure. A return feed to the hydraulic fluid reservoir drains off the fluid medium not required to pressurize said pressure responsive pistons.

A yet further aspect of the preferred embodiment of the present invention comes in the use of camlobe profiles of dissimilar characteristics within a pair of camlobes actuating a pair of valves jointly associated with a common function of induction or exhaust; thus allowing variations in the rate of increase of valve open area; and the rate of decrease of valve open area, during the opening and closing phases respectively, of the processes of induction and exhaust.

A further aspect of the present invention is in the use, where desirable, of different sized valves within a pair of common function, rather than using a pair of valves of identical size, as is conventional practice. This adaptation offering variations in the fields of turbulence, swirl and scavenging in the combustion chamber and cylinder of an internal combustion engine, by varying rates of increase of valve open area, and rates of decrease of valve open area. Variations in volume and direction of gas flow and turbulance in the cylinder also result with different combinations of valve size.

A further aspect of the present invention lies in the variations in swirl, turbulence and scavenging offered by varying which valve of a pair associated with a single function opens first, this factor producing variations recognized in the art as desirable for optimizing performance. The just described variation in valve opening priority coming about by changing a drum from one valve of a pair to the other valve of a pair, and is a feature of value both in development engineering, in production model changes, and in numerous other ways.

It is also possible to employ other means than the hydraulic systems set forth hereinbefore, which may take the form of solonoids or the like controlled by electronic circuits in the form of microcomputers and the like.

It will be further noted that the radial orientation of the bucket tappet with respect to the rocker arm driving the bucket tappet is maintained by sufficient extension of the roller pivot locating structural extensions of the bucket tappet to encompass operatively, by overlapping, both sides of the rocker arm driving the bucket tappet. See FIG. 2.

The foregoing description of the preferred embodiment of the invention has been presented for the purpose of illustration and description. It is not intended to be exhaustive or to limit the invention to the precise form disclosed. Many modifications and variations are possible in the light of the above teaching. It is intended that the scope of the invention be limited not by this detailed description, but rather by the claims appended hereto.

What is claimed is:

1. A mechanism to variably combine the durations of a pair of valves jointly associated functionally with one of a process of induction and exhaust within the combustion chamber of an Internal Combustion engine having a crankshaft, so as to vary, relative to crankshaft revolution, the duration of said one of a process of induction and exhaust associated functionally with said pair of valves, said mechanism comprising:

a camshaft;

said camshaft having at least two cams;

a first housing fixed relative to said engine;

a first drum rotatably embraced by said first housing, said first drum being of common axis with said camshaft, the periphery of said first drum being interposed between one of said cams and said first housing;

a first rocker arm having a fulcrum end for rotation about a pivot fixed within said drum, and a free end capable of substantially reciprocal motion;

said first rocker arm being reciprocally movable by said cam, to in turn, reciprocate a first valve of said pair;

a second housing fixed relative to said engine;

a second drum rotatably embraced by said second housing, said second drum being of common axis with said camshaft, the periphery of said second drum being interposed between another of said cams and said second housing;

a second rocker arm having a fulcrum end for rotation about a pivot fixed within said second drum, and a free end capable of substantially reciprocal motion;

said second rocker arm being reciprocally movable by said cam, to, in turn, reciprocate a second valve of said pair; and means to rotate said first and said second drums relative to each other, for varying the phasing of said first valve relative to the phasing of said second valve, so as to variably combine the duration of said first valve associated functionally with said first drum, and the duration of said second valve associated functionally with said second drum;

said variably combined durations of said pair of valves varying the duration of said one of a process of induction and exhaust associated functionally with said pair of valves.

2. A mechanism as in claim 1 wherein said means to rotate said first and said second drums relative to each other comprises;

a first hydraulic pressure responsive piston reciprocatively received within a first hydraulic cylinder fixed relative to said first housing to define a first hydraulic chamber;

a first shift linkage operatively interconnecting said first hydraulic pressure responsive piston and said first drum, whereby reciprocation of said first hydraulic pressure responsive piston, in response to first control signal means, rotates said first drum, relative to rotation of said cam, in a direction tending to advance the opening point of said first valve of said pair in relation to crankshaft rotation;

a second hydraulic pressure responsive piston reciprocatively received within a second hydraulic chamber fixed relative to said second housing to define a second hydraulic chamber;

a second shift linkeage operatively interconnecting said second hydraulic pressure responsive piston and said second drum, whereby reciprocation of said second hydraulic pressure responsive piston, in response to second control signal means, rotates said second drum, relative to rotation of said cam, in a direction tending to retard the closing point of said second valve with respect to crankshaft rotation;

the variable opening point, relative to crankshaft rotation, of said first valve of said pair, and the variable closing point, relative to crankshaft rotation, of said second valve of said pair, producing cooperatively, variable duration, relative to crankshaft rotation, of one of a process of induction and exhaust associated functionally with said pair of valves.

3. A mechanism as in claim 2 wherein said control signal means comprises:

a first pressure proportioning valve which proportions the hydraulic pressure fed to said first hydraulic pressure responsive piston from a source of hydraulic fluid under pressure in response to control signal means representing one or more engine operating requirements;

a second pressure proportioning valve which proportions the hydraulic pressure fed to said second hydraulic pressure responsive piston from a source of hydraulic fluid under pressure in response to control signal means representing one or more engine operating requirements.

4. A mechanism as in claim 3 further comprising variable valve lift apparatus, said apparatus comprising;

each said drum having a pivot for rotatably locating said respective rocker arm;

each said rocker arm having a fulcrum end and a free end, said fulcrum end rotating about said pivot in said drum, said fulcrum end and said free end being connected by an arcuate surface for engaging operationally said respective valve, said arcuate surface having a curvature defined by a radius having its center coincident with the axis of said camshaft, said arcuate surface and said rocker arm pivot having a predetermined positional relationship suitable to maintain, throughout the angular operational range of said drum, a predetermined clearance between said rocker arm and said respective valve driven by said rocker arm, with said valve in a closed position;

said rocker arm having means for biasing said rocker arm into sliding engagement with said cam;

said biasing means being a spring; said drum, in response to control signal responsive means, being rotated angularly, relative to rotation of said cam, said angular rotation of said drum adjusting the distance relationship between the fulcrum end of said rocker arm and a valve engagement point of said arcuate surface of said rocker arm, said adjustment varying the ratio between lift of said camlobe, and displacement of said rocker arm driven by rotation of said cam.

5. A mechanism as in claim 4 wherein, a pair of valves of common function and capable of timings variable relative to crankshaft revolution within a common combustion chamber are of different sizes.

6. A mechanism as in claim 5, wherein, within a common combustion chamber, either valve of a pair jointly associated with one of a process of induction and exhaust may have priority of opening at timings advanced or retarded relative to crankshaft revolution.

7. A mechanism as in claim 6, wherein a pair of camlobes associated for driving purposes with a pair of valves jointly associated with one of a process of induction and exhaust are of dissimilar profiles.

8. The mechanism as in claim 7, further comprising: means to maintain appropriate radial orientation of said bucket tappet relative to said rocker arm.

* * * * *